United States Patent [19]

Pace et al.

[11] Patent Number: 4,464,417

[45] Date of Patent: Aug. 7, 1984

[54] METHOD FOR MINIMIZING CONTAMINANT PARTICLE EFFECTS IN GAS-INSULATED ELECTRICAL APPARATUS

[75] Inventors: Marshall O. Pace; James L. Adcock, both of Knoxville; Loucas G. Christophorou, Oak Ridge, all of Tenn.

[73] Assignee: The United States of America as represented by the Department of Energy, Washington, D.C.

[21] Appl. No.: 463,208

[22] Filed: Feb. 2, 1983

[51] Int. Cl.[3] ..... B05D 3/14

[52] U.S. Cl. ..... 427/41; 174/14 R; 252/372; 427/58; 427/116; 427/221

[58] Field of Search ..... 427/40, 41, 39, 212, 427/215, 216, 220, 221, 58, 116; 174/14 R; 252/372

[56] References Cited

U.S. PATENT DOCUMENTS

| | | | |
|---|---|---|---|
| 3,669,885 | 6/1972 | Wright et al. | 204/168 |
| 3,676,350 | 7/1972 | Wright et al. | 204/168 |
| 4,054,680 | 10/1977 | Sharbaugh et al. | 427/41 |
| 4,201,672 | 5/1980 | Christophorou et al. | 252/372 |
| 4,309,307 | 1/1982 | Christophorou et al. | 252/372 |
| 4,335,268 | 6/1982 | Dale | 174/14 R |

*Primary Examiner*—John H. Newsome

*Attorney, Agent, or Firm*—Edwin D. Grant; Stephen D. Hamel; Michael F. Esposito

[57] ABSTRACT

Electrical breakdown of a gas insulator in high voltage apparatus is prevented by placing an electrical insulative coating on contaminant particles in the gas insulator.

3 Claims, No Drawings

METHOD FOR MINIMIZING CONTAMINANT PARTICLE EFFECTS IN GAS-INSULATED ELECTRICAL APPARATUS

BACKGROUND OF THE INVENTION

This invention, which resulted from a contract with the United States Department of Energy, relates generally to gas insulated, high voltage electrical apparatus and more particularly to a method for eliminating the detrimental effects that mobile electrically conductive or semiconductive particles have on the gas insulator in such apparatus.

One of the problems encountered in the operation of gas insulated, high voltage electrical systems is that resulting from the contamination of an insulating gas by electrically conductive or semiconductive particles. Such particles, which may be introduced into an electrical system during its fabrication or formed after it is placed in operation, lower the dielectric strength of an insulating gas and cause premature failure of the apparatus in which the gas is used.

SUMMARY OF THE INVENTION

A primary object of the invention is to improve the operation of gas insulated, high voltage electrical equipment.

Another object of the invention is to protect an electrical insulating gas in high voltage electrical equipment from the harmful effects of electrically conductive or semiconductive particles accumulated therein.

These objects are accomplished by placing an electrical insulating coating on the electrically conductive or semiconductive particles which are adventitiously included in a gas insulated, high voltage electrical apparatus during its manufacture or which are formed therein during its operation. Insulative coatings can be formed on such particles by passing an electrical discharge through a gas placed in an electrical apparatus solely for the purpose of producing an electric insulating coating on the particles. Alternatively, the gas which produces the desired electrical insulating coating on contaminant particles can be part of the gaseous atmosphere used in an electrical apparatus as an insulator for ordinary operation. The scope of the invention encompasses any method for coating the harmful particulates in a gas insulated, high voltage apparatus with an electrical insulating coating.

DETAILED DESCRIPTION OF THE INVENTION

Tests conducted by the inventors have shown that contaminant particles introduced into the gas used as an insulator in high voltage electrical apparatus can be coated with an insulating film and thereby made less destructive to the insulating capacity of the gas. In some instances, it was found that the voltage necessary to cause an electrical discharge through a gas containing coated conductive particles was substantially the same as the breakdown voltage for the same gas with no particles therein. The inventors have further discovered that conductive particles can be coated with an electrical insulating film in situ in a gas insulated apparatus by subjecting the gas insulator to a weak electrical discharge. Other methods of coating an insulating gas with a dielectric film may also be employed. For example, gases which react together to form a polymer can be introduced into a chamber to coat particles therein.

The formation of polymer films by glow discharge has been essentially an empirical art, but some major observations are possible. Glow discharges are generally used with radio frequency, low frequency AC, or with DC in pressures of 0.1 to 5 torr. Radio frequency is suitable for use in carrying out the invention, primarily because with it a coating is formed on an electrically floating substrate. Hydrocarbons generally polymerize successfully in this process of coating particles by glow discharge in a gas, but many fluorocarbons do also, especially those with a fluorine:carbon ratio of $\sim 2$ and a structure with either cyclic nature or multiple bonds. If the fluorine:carbon ratio is not $\sim 2$, excess fluorine can be removed by adding $H_2$, or excess carbon can be removed by adding $O_2$.

DC voltages were applied to the commonly used insulative gas $SF_6$ with and without conductive particles therein, the particles being in the form of copper wires with 0.0381 cm diameter and 0.3175 cm length. The tests were conducted by use of a simulated high-voltage apparatus consisting of an inner cylinder electrode with a diameter of 0.75 cm and an outer tubular housing with an inside diameter of 4 cm, the housing being concentrically disposed around the inner electrode and the housing being formed of brass and the inner electrode being formed of stainless steel. Two sets of the test devices were used in the tests, the lengths of the inner electrodes and housing in the two sets being different, about 21 cm and 31 cm for the respective housings including a flared end portion having a length of 11 cm. In both sets of the test apparatus, the inner electrodes projected 3 cm beyond each end of the associated housing. Each electrode system was enclosed in a stainless steel chamber during the tests to preclude the introduction of extraneous particles into the $SF_6$ insulator used in the tests. Voltages at which the $SF_6$ gas in the test equipment conducted an electrical current (referred to hereinafter as the breakdown voltage) were found to be essentially identical for the two sets of test apparatus of different length. DC voltage was applied to the inner electrode through a 300 kV DC programmable power supply designated as Deltatron Model L300-2C. Control systems which were used in the tests provided power supply operation in three modes, viz., manual voltage control, manual current control, and automatic voltage ramp with decrease upon breakdown of the $SF_6$. Tests were conducted with uncontaminated $SF_6$ in the apparatus to determine breakdown voltage of the clean system. Then tests were conducted with the introduction of the above-described copper particles into the $SF_6$ in the same test apparatus, voltage applied across the inner electrode and its surrounding housing being slowly increased until breakdown of the gas insulator occurred. Each test condition was repeated several times to obtain an average breakdown voltage. In certain tests, contaminant particles were coated with an electrical insulative film before the particles were introduced into the test apparatus (e.g., see Test 3 in the following table, which lists results of ten of the conducted tests). In other instances, an electrical insulative film was applied to the copper particles by placing them in the test equipment and then applying a voltage to an appropriate gas (e.g., a mixture of 1-$C_3F_6$, $C_2F_4$, c-$C_4F_8$ (i.e. cyclo-$C_4F_8$), 2-$C_4F_8$) which produced an electrical current in the gas for a selected period of time (e.g., see Test 5 and 6 in the following table, wherein results and observations are listed under the headings "Breakdown Test Results" and "Commentary" and conditions used in the tests are listed under the heading "Control Method Applied").

TABLE Ia

Preliminary results of two particle-contamination control techniques, obtained with DC test voltage between coaxial cylinders of inner radius 0.75 cm and outer radius 2 cm in 101.3 kPa of $SF_6$. Contaminating particles are (originally clean) copper wires, 0.0381 cm diameter × 0.3175 5 cm length. (This heading also applies to Table Ib).

| Test No. | No. of Test Particles Used | Control Method Applied |
|---|---|---|
| 1 | 5 | None |
| 2 | 0 | None |
| 3 | 3 | Particles coated by hand with enamel on sides and epoxy on ends. |
| 4 | 1 | None |
| 5 | 1 | Particles hovered under stress in test electrodes for 30 min. in a 101.3 kPa mixture of 60% 1-$C_3F_6$/40% $SF_6$. |
| 6 | 8 | 0.1 cm radius inner electrode discharged for 40 hours in 26.7 kPa of 1-$C_3F_6$ at 1.6 mA, with power supply in controlled-current mode; particles stationary |
| 7 | 2 | 16 hours glow discharge in flowing $C_2F_4$ at 0.27 kPa in chamber separate from test chamber. |

down voltage of the uncontaminated $SF_6$, as exemplified by Text Example 2. It has been found that other gases commonly used as insulators in high voltage electrical apparatus, such as $C_2F_4$, 1-$C_3F_6$, c-$C_4F_8$ and 2-$C_4F_8$, also form an electrical insulative film on conductive particles therein when an electrical discharge is produced in the gases.

The coatings referred to in the test data presented herein are polymers formed by partial discharges in fluorocarbon gases such as $C_2F_4$, 1-$C_3F_6$, 2-$C_4F_8$, or c-$C_4H_8$. It has been found that:

(1) an insulating coating on conducting particles can render them harmless, thus increasing the withstand voltage of an electrical system by at least threefold;

(2) particles can be coated in certain stressed gases while moving;

(3) particles can be coated in certain stressed gases while stationary and rendered harmless both in the system where the coating was performed or in a test system to which they were subsequently transferred;

(4) long-term (days) DC stress may cause particle-initiated breakdown at voltages lower than those for short-term DC stress but much higher than breakdown voltages without coatings; and (5) along with the particles the electrodes can also be coated in certain stressed gases.

A typical contaminated system is represented by Test No. 1. Five clean copper particles (0.038-cm diam×0.3175-cm length) were placed in the test concentric cylinder electrodes, and the voltage was repeatedly raised slowly to breakdown. Ten such breakdown TABLE Ib

| Test No. | Breakdown Test Results Following Application of Control Method: No. Breakdowns | Mean Breakdown Voltage | Commentary |
|---|---|---|---|
| 1 | 10 | 24.2 kV | A typical contaminated system with no particle control measures. |
| 2 | 20 | 58.1 kV | A typical uncontaminated system. |
| 3 | 5 | 57.9 kV | Coating rendered particles essentially harmless (see 1, 2 results). |
| 4 | 10 | 29.35 kV | A typical system contaminated by one particle (compared with 5). |
| 5 | 10 | 33.05 kV | A moving particle may be beneficially coated, particle ends visibly coated. |
| 6 | 12 | 52.8 kV | Faint coating visible on electrodes and particles; particle surfaces still shiny. In one test, a spark hit one particle, ejecting it out of electrode end. (No breakdown involved particles, which remained stationary). |
| 7 | 16 | 55.2 kV | Particles transferred from cell where coating was performed to a clean test cell. |

Under "Control Method Applied" in Tests 5 and 6 the following definitions are applicable. "Hovered" means the particles were suspended between electrodes with little motion by electrical forces and "stationary" means the particles were at rest on the electrode surface. The "coating observed" on particles was a slight discoloration on their tips; on the electrode surfaces the coating was more easily seen and was a thin, dark bronze, translucent coating.

It will be noted that Test Example 6 and 7 show that when contaminant particles in a gas insulated, high voltage electrical system are coated with an electrical insulative film in accordance with the principles of the invention, breakdown voltage of the contaminated $SF_6$ gas insulator was substantially the same as the breakdown voltages had a mean of 24.2 kV. In Test No. 2 the similarly obtained mean breakdown voltage for an uncontaminated system was 58.1 kV over 20 trials. The effectiveness of a particle control technique is therefore taken to be reflected by how high it can raise the test system breakdown voltage in the range from 24.2 kV to 58.1 kV.

It was observed that conducting particles are less harmful when coated with an insulating film and, in some cases, do not cause breakdown at a voltage any lower than that at which the clean gas gap breaks down. For example, in Test No. 3 three particles, identical to particles used in Test No. 1 except that their bodies were left coated with enamel and their ends were coated with epoxy, caused one breakdown at 58.9 kV and then the gas gap broke down four times, without particle participation, at a mean of 57.7 kV.

It was observed that stressing a contaminated system can produce a helpful coating on the particles while they are moving. For example, in Test No. 4 one copper particle (0.031-cm diam×0.3175-cm length) between concentric cylinders of radii 0.75 cm and 2 cm and in 101.3 kPa $SF_6$ caused breakdowns at a mean of 29.35 kV. In Test No. 5 one similar particle was caused to hover at the same center electrode for 30 minutes in a 101.3-kPa mixture of 60% 1-$C_3F_6$ and 40% $SF_6$; the particle ends were slightly coated and upon return of the 101.3-kPa $SF_6$ the particle caused breakdowns in the above geometry at a mean of 33.05 kV. The presence of $SF_6$ can inhibit the coating process, however.

It was further observed that stationary particles can be coated in situ by discharge. Thus, in Test No. 6 the 0.75-cm-radius inner electrode was temporarily replaced by a 0.1-cm-radius electrode and eight clean copper particles (0.0381-cm diam×0.3175-cm length) were placed on the outer electrode. A discharge at 1.6 mA in 26.7 kPa of 1-$C_3F_6$ for 40 hours was facilitated by adding a controlled-current mode to the power supply control. A faint coating was observable on the electrodes and particles, but the metal surfaces and particles still appeared shiny. Following this, the 0.75-cm-radius stainless steel rod was inserted in the system as the center electrode, and 12 measurements of the DC breakdown voltage gave a mean of 52.8 kV as compared with the mean of 24.2 kV without this coating treatment. These breakdowns occurred in the gas without involving any particles; the 13th breakdown did move one of the particles, which escaped at the electrode end without harm to the dielectric integrity of the system. Although the larger diameter inner electrode was used for dielectric tests, it was necessary to substitute the smaller one to obtain a discharge of practical current density.

When particles were coated in an environment separate from that in which the breakdown tests themselves were made, they were also rendered less harmful. For example, in Test No. 7 two copper particles, again 0.0381-cm diam×0.2175-cm length, were left stationary for 16 hours in a glow discharge in 027 kPa of flowing $C_2F_4$. When transferred to the test cell (cylindrical electrodes of radii 0.75 cm and 2 cm), the particles appeared to move only twice, when breakdowns occurred at 55.3 kV and 53.4 kV, out of 16 breakdowns at a mean of 55.2 kV. The untreated particles caused breakdowns at a mean of 24.2 kV.

After obtaining the above-described results which showed the coating technique can be performed and can render particles harmless, the inventors testing the long-term (hours to days) behavior of coated particles under DC stress. This work was done because the previous results were for short-term stress, which would confirm the feasibility of the method for AC; however, on long DC stress there could be sufficient leakage in the insulating coating to eventually allow particle charging, and subsequently, particle levitation.

In one long-term stress test eight particles were coated by a discharge of 1.0 mA in 26.7 kPa of 1-$C_3F_6$ from a 0.1-cm-radius (negative) inner electrode. The discharge lasted between 74 and 88 hours, with uncertainty due to an accidental trip-out of the power supply. The discharge current was controlled by the feedback circuit developed for that purpose. The electrodes were then inspected, and the inner electrode was replaced by the 0.75-cm-radius electrode. The inner surface of the outer electrode and particles appeared lightly coated. One particle was lost during inspection, and the remaining seven particles were subjected to a negative voltage of 45 kV on the inner electrode in 101.3 kPa of $SF_6$. For 5 hours no breakdowns occurred, although an uncoated system of this type had a mean breakdown voltage of 24.2 kV in short-term tests. However, nine breakdowns were recorded by the automatic system over the next 24 hours. Later inspection revealed that all particles had escaped in these breakdowns. In another long-term stress test, four particles were coated by a discharge of 1.5 mA in 26.7 kPa of 1-$C_3F_6$ from the 0.1-cm-radius (negative) inner electrode. The discharge last 118 hours, and the gas was replaced after the first 72 hours. The electrodes and particles were heavily coated with an uneven material projecting as much as 1.5 mm from the surface in some locations. The inner electrode was replaced by the 0.75-cm-radius clean electrode and 35 kV (negative inner electrode) was applied for 45 hours. No breakdowns occurred during this period, so the coating had improved the system's voltage withstand capability by a considerable margin.

What is claimed is:

1. A method for preventing a reduction in the dielectric strength of a gas insulator in high voltage electrical apparatus resulting from the inclusion of electrically conductive or semiconductive particles therein, comprising placing an electrical insulative coating on said particles while said gas insulator is in said apparatus.

2. The method of claim 1 wherein said electrical insulative coating is placed on said particles by:

placing in said electrical apparatus a gas mixture containing $SF_6$ and a particle coating gas; and producing an electrical discharge in said gas mixture to thereby cause said particle coating gas to form said electrical insulative coating on said particles.

3. The method of claim 2 wherein said particle coating gas is selected from the group consisting of $C_2F_4$, 1-$C_3F_6$, c-$C_4F_8$ and 2-$C_4F_8$.

* * * * *